US009541898B2

(12) United States Patent
Shiomi

(10) Patent No.: US 9,541,898 B2
(45) Date of Patent: Jan. 10, 2017

(54) IMAGE FORMING APPARATUS

(71) Applicant: CANON KABUSHIKI KAISHA, Tokyo (JP)

(72) Inventor: Tomohiro Shiomi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/001,688

(22) Filed: Jan. 20, 2016

(65) Prior Publication Data

US 2016/0209806 A1 Jul. 21, 2016

(30) Foreign Application Priority Data

Jan. 21, 2015 (JP) ..... 2015-009329

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 15/2017
USPC ..... 399/92, 93
See application file for complete search history.

(56) References Cited

U.S. PATENT DOCUMENTS

| | | | | |
|---|---|---|---|---|
| 7,477,860 | B2 | 1/2009 | Hanano | |
| 7,844,194 | B2 | 11/2010 | Hanano | |
| 2008/0050145 | A1* | 2/2008 | Hanano | G03G 15/2017 399/93 |
| 2013/0236207 | A1* | 9/2013 | Hirakawa et al. | G03G 21/206 399/92 |

FOREIGN PATENT DOCUMENTS

| | | | |
|---|---|---|---|
| JP | 2008-077077 | A | 4/2008 |
| JP | 2008-203703 | A | 9/2008 |

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image forming station configured to form an image on a recording material; an electric circuit configured to operate the image forming station; a casing configured to accommodate the electric circuit; a recess provided on the casing; a voltage source input portion provided on a wall surface of the recess and configured to supply electric power to the electric circuit from an outside of the casing; and an air vent opening formed in a wall surface of the recess for permitting air flow between an inside and an outside to cool an inside of the casing.

10 Claims, 4 Drawing Sheets

IMAGE FORMING APPARATUS

FIELD OF THE INVENTION AND RELATED ART

The present invention relates to an image forming apparatus including a casing accommodating an image formation mechanism and an electric circuit for operating the image formation mechanism.

An image forming apparatus of an electrophotographic type is widely used as a printer, a copying machine, a facsimile machine and so on. The image forming apparatus of this kind includes a number of heat generation sources such as a heat-fixing device, an image forming unit, an exposure device, a voltage source device, various electrical parts and the like, in the machine. For example, in the inside of the image forming apparatus, a temperature rise by the heat-fixing device, a temperature rise of a bearing of a developing device, a temperature rise by frictional heat of the developer, and so on are produced. If cooling air ventilation at or adjacent to the heat generation sources is insufficient, resin material parts constituting the image forming apparatus may be deformed by the heat, the property of the toner may change with the result of image defect, or malfunction of the electrical parts may occur. For this reason, the cooling and/or ventilation at the heat generation source in the image forming apparatus is a technical task in such an apparatus.

Recently, the downsizing of the main assembly of the apparatus is required for the improvement in the disposition space efficiency, and on the other hand, it may be desired that a side or rear surface of the casing of the image forming apparatus is in contact with a wall in the installation place. In such a case, the suction/exhaustion opening is closed with the result of decrease of the suction efficiency, and therefore, the heat produced in the heat-fixing device, the image forming unit, the exposure device and various electrical parts tends to stagnate in the casing.

Particularly, attention should be paid to avoid the temperature rise in the neighborhood of the image forming unit and/or the electrical parts, but the limitation to the casing size makes difficult the provision of the parts and/or the space exclusively for the suction and discharging, with the result of the difficulty in the assuring the efficient air path. Under the circumstances, a proposal has been made in which the air path is constituted by the parts and/or portion having the other functions.

Japanese Laid-open Patent Application 2008-077077 discloses a structure in which a venting louver (venting hole) is provided utilizing a grip portion provided on the front side of a sheet feeding cassette to facilitate pulling the sheet feeding cassette out of the main assembly of the image forming apparatus.

On the other hand, Japanese Laid-open Patent Application 2008-203703 discloses a structure in which a venting louver is provided at the recessed grip portion on the front cover for the access into the inside of the apparatus to cool the inside by suction and discharge of the air to and from the outside of the apparatus. However, such conventional examples involve problems.

The opening and closing cover having the grip portion in the image forming apparatus is often in the front side of the casing of the main assembly of the apparatus or the lateral side where a jammed sheet if any is removed. In the sheet feeding cassette having the grip portion, the grip portion is provided in the front side of the image forming apparatus in many cases, because the cassette pulling direction is the rear-front direction of the image forming apparatus. In the case that the venting louver is provided in the front side, the neighborhood of the image forming process device and the constituent elements of the electric circuits can be efficiently cooled, because they are arranged from the central portion to the front side with respect to the rear-front direction of the image forming apparatus.

On the other hand, generally speaking, the electrical components which are not required to be accessed by the user, such as a voltage source substrate for supplying electric power to the image formation mechanism including the electrical parts and a high voltage substrate for generating a high voltage, are provided in the rear side of the casing of the image forming apparatus. The amount of the heat generated by these electric circuits is quite large, and therefore, efficient cooling is required for them. However, with the conventional structures in which the cooling air is taken from the front side and is fed to the rear side to cool the electrical parts disposed in the rear side of the casing, the flow path length of the cooling air is long, and therefore, the loss is large, thus preventing the efficient cooling. In order to cool the parts disposed in the rear side of the image forming apparatus, it is required that a suction opening is provided in the rear side of the image forming apparatus to make the flow path length short, thus efficiently cooling them.

The air vent opening for the suction and the discharge of the cooling air is desirably provided in a recessed portion which is recessed from the outer casing or cover taking into account that the image forming apparatus may be placed such that the outer casing of the image forming apparatus is contacted to the wall. However, such a recessed structure results in the reduction of the inside space with the result of upsizing of the apparatus or reduction of the ornamental nature of the outer appearance.

SUMMARY OF THE INVENTION

Accordingly, it is an object of the present invention to provide an image forming apparatus capable of efficiently cooling the electric circuit provided in the image forming apparatus.

According to an aspect of the present invention, there is provided an image forming apparatus comprising an image forming station configured to form an image on a recording material; an electric circuit configured to operate said image forming station; a casing configured to accommodate said electric circuit; a recess provided on said casing; a voltage source input portion provided on a wall surface of said recess and configured to supply electric power to said electric circuit from an outside of said casing; and an air vent opening formed in a wall surface of said recess for permitting air flow between an inside and an outside to cool an inside of said casing.

Further features of the present invention will become apparent from the following description of exemplary embodiments with reference to the attached drawings.

DESCRIPTION OF THE EMBODIMENTS

Referring to the accompanying drawings, an electrophotographic type image forming apparatus according to an embodiment of the present invention will be described. The structures of the image forming apparatus of this embodiment are merely an example, and are subject to change by one skilled in the art within the concept of the present invention. The dimensions, the sizes, the materials, the configurations, the relative positional relationships of the elements in the following embodiments and examples are not restrictive to the present invention unless otherwise stated.

Embodiment

Figure 1:
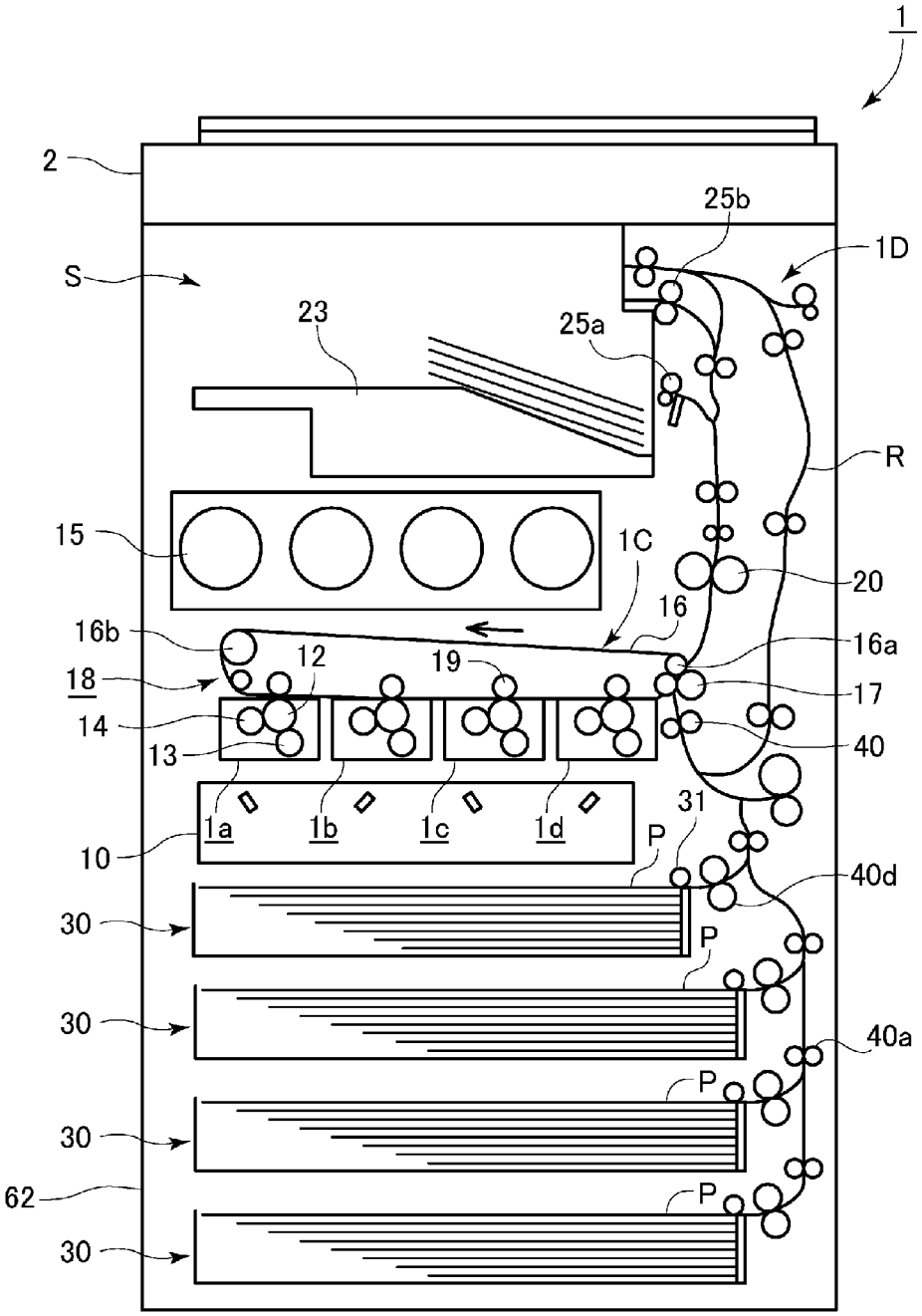
FIG. 1 is a general arrangement of an electrophotographic type image forming apparatus according to an embodiment of the present invention.

The image forming apparatus 1 shown in FIG. 1 includes an electrophotographic type image formation mechanism capable of forming a color image. The image formation mechanism of the image forming apparatus 1 includes process cartridges 1*a*, 1*b*, 1*c* and 1*d* for forming yellow, magenta, cyan and black toner images, respectively. The suffixes (a-d) of the reference numerals correspond to the yellow, magenta, cyan and black, respectively.

The process cartridges 1*a*, 1*b*, 1*c* and 1*d* have the same structures except that the toner colors are different. In FIG. 1, the structural members of the process cartridge 1*a* are depicted by reference numerals 12-14 without the suffixes, but the same applies to the other process cartridges 1*b*, 1*c* and 1*d*.

That is, the process cartridge 1*a* (1*b*, 1*c*, 1*d*) includes a photosensitive drum 12 as an image bearing member (electrophotographic photosensitive member), a primary charger 13 and a developing device 14. In addition, the process cartridge 1*a* (1*b*, 1*c*, 1*d*) may be provided with a driving device such as a motor (unshown) for driving the photosensitive drum 12, or a cleaning mechanism for removing the residual toner from the photosensitive drum 12, but they are omitted in FIG. 1 for the sake of simplicity of explanation. Each of the process cartridges 1*a*, 1*b*, 1*c*, 1*d* is in the form of a unit which is detachably mountable to the image forming apparatus 1. In addition, the portion including the developing device 14 and the photosensitive drum 12 may be in the form of an independent developing device cartridge or a drum cartridge.

Below the process cartridge 1*a*, 1*b*, 1*c*, 1*d*, a laser source for generating recording light beam, and an exposure device 10 including a polygonal mirror for deflecting the recording light beam are provided. The photosensitive drum 12 of the process cartridge 1*a*, 1*b*, 1*c*, 1*d* is exposed to the recording light beam by the exposure device 10 so that an electrostatic latent image is formed on the surface of the photosensitive drum, corresponding to the image color.

The recording light beam is modulated in accordance with an image signal supplied from communicating means (unshown) in the case that the image forming apparatus 1 is a printer or facsimile machine. In the case that the image forming apparatus 1 is a copying machine, the image signal is provided by reading an original using a scanner 2 provided in the upper portion of the apparatus.

The electrostatic latent image formed on the photosensitive drum 12 in the process cartridge 1*a*, 1*b*, 1*c*, 1*d* is developed into a toner image by the corresponding developing device 14 in the process cartridge 1*a*, 1*b*, 1*c*, 1*d*. The developing device 14 is supplied with the toner from toner bottles 15 containing the yellow, magenta, cyan and black toner particles, respectively, and disposed above the intermediary transfer belt 16.

Above the photosensitive drum 12 of the process cartridge 1*a*, 1*b*, 1*c*, 1*d*, a transfer belt unit 18 is provided. The transfer belt unit 18 includes an intermediary transfer belt 16 as an intermediary transfer member extending along the process cartridges 1*a*, 1*b*, 1*c*, 1*d* (left-right direction in the Figure).

The intermediary transfer belt 16 is stretched around driving and idle rollers 16*a*, 16*b* to travel facing the process cartridges 1*a*, 1*b*, 1*c*, 1*d*. In the back side of the intermediary transfer belt 16, primary-transfer rollers 19 are provided opposed to the photosensitive drums 12 of the process cartridges 1*a*, 1*b*, 1*c*, 1*d*, respectively. By primary transfer bias voltages applied to the primary-transfer rollers 19, the toner images are transferred onto the intermediary transfer belt 16 superimposedly, so that a color toner image is formed. The color toner image is transferred onto a recording material by a secondary transfer bias voltage applied to the secondary transfer roller 17 opposed to the roller 16*a*.

The formation of the color image will be described in more detail. A laser beam modulated by a yellow component color image signal is projected onto the photosensitive drum 12 of the process cartridge 1*a*, so that the electrostatic latent image is formed on the photosensitive drum 12. The electrostatic latent image is developed with the yellow toner by the developing device 14 into a yellow toner image.

The yellow toner image is carried on the rotating photosensitive drum 12 to reach the primary transfer portion where the intermediary transfer belt 16 is contacted with the photosensitive drum 12. In the primary transfer portion, the yellow toner image is transferred from the photosensitive drum 12 onto the intermediary transfer belt 16 (primary-transfer) by the primary transfer bias applied to the transfer roller 19.

By the rotation of the intermediary transfer belt 16, the yellow toner image on the intermediary transfer belt 16 travels toward the right in the Figure to reach the next image forming station including the process cartridge 1*b*. At this time, a magenta toner image is formed on the photosensitive drum 12 of the process cartridge 1*b*, similarly to the previous image forming station. The magenta toner image is transferred superimposedly onto the yellow toner image already on the intermediary transfer belt 16 in the primary transfer portion where the intermediary transfer belt 16 contacts the photosensitive drum 12 of the process cartridge 1*b*. Similarly, with the traveling movement of the intermediary transfer belt 16, the cyan toner image and the black toner image are transferred sequentially on the yellow toner image plus magenta toner image in the secondary transfer portion.

In this manner, the respective color toner images on the process cartridges 1*a*, 1*b*, 1*c*, 1*d* are transferred onto the intermediary transfer belt 16.

On the other hand, the recording material P (paper or plastic resin material sheets) is accommodated in a cassette 30 disposed in the lower portion of the apparatus. A plurality of cassettes 30 are provided to accommodate different size recording materials P. The cassettes 30 can be pulled out toward the front side of the apparatus when the recording material P is to be replenished, for example.

The recording material P is taken out of the cassette 30 one by one by the pick-up roller 31 and is supplied to the recording material feeding path 1D by the pair of rollers 40*a*, 40*a*. The recording material P is fed along a left side path of the recording material feeding path 1D in the Figure, and is subjected to the control by the registration rollers 40 in the timing and attitude, and then is fed to the secondary transfer portion (secondary transfer roller 17).

By the secondary transfer bias voltage applied to the secondary transfer roller 17 as the transferring means, the four color toner images on the intermediary transfer belt 16 are transferred altogether onto the recording material P (secondary-transfer).

The recording material P now having the four color toner images transferred thereonto is fed upwardly along the recording material feeding path 1D while being guided by the feeding guide. The recording material P carrying the four color toner images is fed into a heat-fixing device (a pair of fixing rollers) 20 as fixing means provided above the secondary transfer roller 17, where the recording material P is subjected to heat and pressure, so that the four color toner image is fixed. By this, the color toner particles are melted and mixed, so that a full-color printed image is formed on the recording material P.

Thereafter, the recording material P having the fixed image is fed by a pair of discharging rollers 25*a*, 25*b* as discharging means provided downstream of the heat-fixing device 20 while being guided by the feeding guide, and is discharged onto the discharging tray 23.

The foregoing is the description of the operation in a simplex mode (one-sided image formation). In the case of a duplex mode in which the images are formed on both sides of the recording material P, the recording material P on which the image has been formed on one side thereof in the above-described manner is fed along a both-side-printing path R provided on the right side of the recording material feeding path 1D in the Figure, where the facing orientation is reversed, and is fed to the registration rollers 40. Then, the image forming process described above is carried out on the back side of the recording material, and the recording material P having the images on both sides is discharged onto the discharging tray 23 by the pair of discharging rollers 25*a*, 25*b*.

The process cartridges 1*a*-1*d* and/or the transfer belt unit 18 have service lives which are shorter than that of the image forming apparatus 1, and therefore, it is required to replace them before the end of the service life of the image forming apparatus 1. Therefore, it is preferable that the structure is such that each of the process cartridges 1*a*-1*d* and the transfer belt unit 18 are mountable and dismountable. By doing so, the maintenance property is improved, and the image forming apparatus 1 can be used for a long term.

Figure 2:
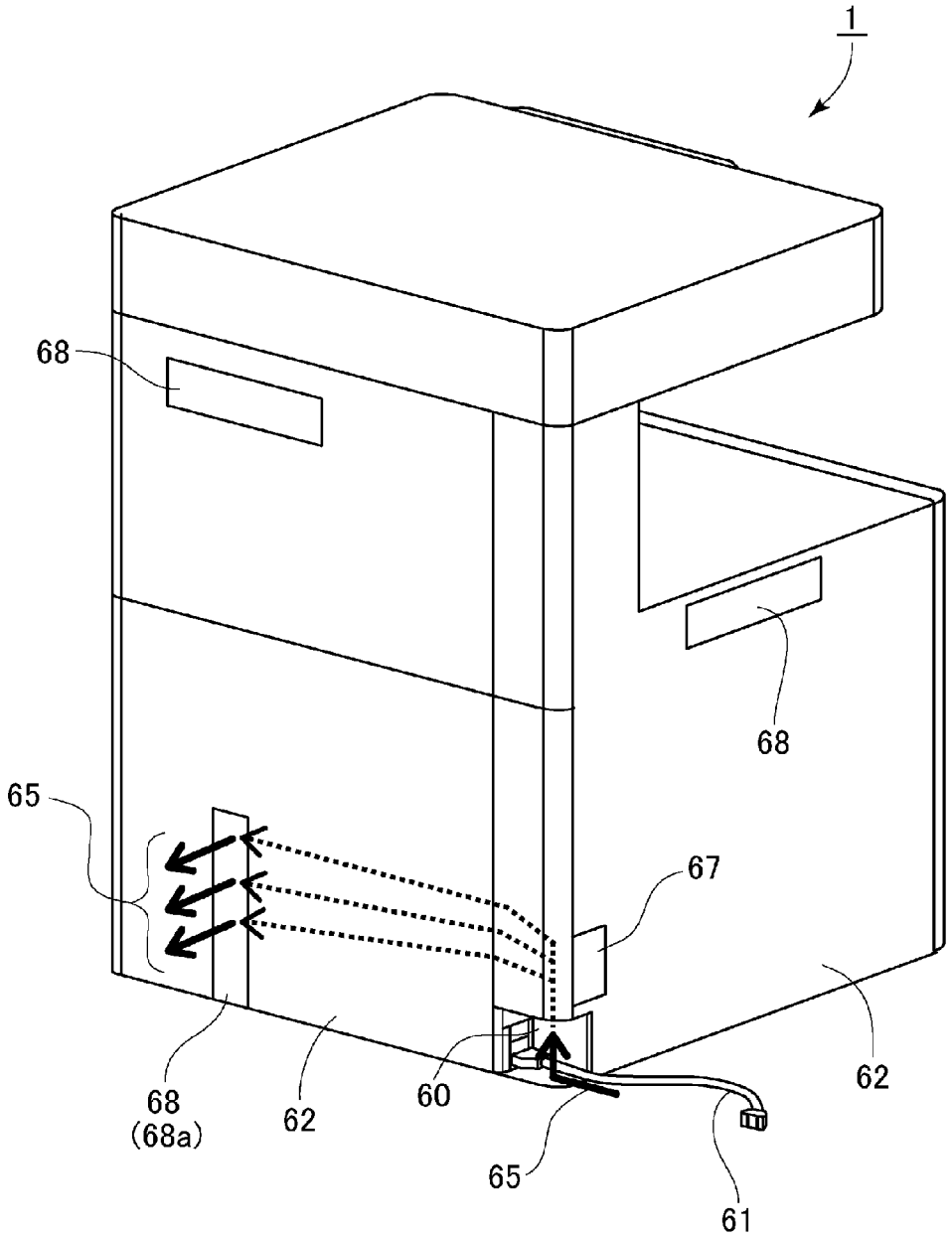
FIG. 2 shows an outer appearance of the image forming apparatus as seen from a rear side.

FIG. 2 is a perspective view showing an outer appearance as seen from a rear side of the image forming apparatus 1 of FIG. 1. The left side (right side in the Figure) of the casing 62 of the image forming apparatus 1 is provided with a recess 60. The recess 60 is provided by cutting away a rear side bottom corner portion of the casing 62 into a substantially rectangular parallelepiped vacant shape which is formed by two vertical surfaces (walls) and a top surface (wall).

A function of recess 60 is to extend out a voltage source cable 61 for supplying the electric power to the inside image formation mechanism, and particularly to a voltage source device for operating the image formation mechanism and to the electric circuit such as the high voltage circuit. The voltage source cable 61 is extended through the laterally facing vertical surface which is one of the wall surfaces defining the recess 60, as shown in FIG. 2, for example. In this case, the voltage source cable 61 is extended directly through the casing 62 or through a connector.

With this structure in which the voltage source cable 61 as the voltage input portion is extended out through the recess 60 of the casing 62 of the image forming apparatus 1, the outside part of the voltage source cable 61 is accommodated in the recess 60. The outside part of the voltage source cable 61 is a connector (not shown), for example, or a cable protection bush material (not shown) in the case of the direct structure. Ordinarily, the outside part of the voltage source cable 61 has a higher rigidity than the wire portion of the voltage source cable 61, and therefore, is difficult to deform. In consideration of the certainty of the electrical connection and the durability, an external force applied to the connector or the direct outlet portion is not preferable.

When the outside portion of the voltage source cable 61 is provided at the most outer surface of the casing 62, it is difficult to reduce the distance between the outermost surface of the casing 62 and the wall of the installation place of the image forming apparatus 1 (close-contact state, for example). In addition, in such a case, there is a possibility that the surface of the casing provided with the outside part of the voltage source cable 61 may be forced closer to the wall of the installation place, or the voltage source cable 61 or the outside portion thereof is sandwiched between the casing and the wall of the installation place. In such a case, the certainty of the electrical connection and/or the durability will be deteriorated.

On the other hand, according to this embodiment, as shown in FIG. 2, the outside portion of the voltage source cable 61 is provided at the wall surface of the recess 60 provided in the casing 62. According to such a structure, the influence to the certainty of the electrical connection and/or to the durability attributable to the undesirable external force applied to the voltage source cable 61 or the outside part thereof can be avoided. When the image forming apparatus 1 is installed, it will be easy to reduce the distance between the rear surface or side surface of the casing and the wall of the installation place (the state of almost close-contact, for example), so that the space efficiency of the installation place can be improved.

In this embodiment, the recess 60 is disposed at the lower corner portion where the rear surface and the side surface of the casing 62 cross with each other, but the position of the recess 60 is not limited to such a corner portion, but may be another position such as the side surface of the casing 62, for example.

In this embodiment, the recess 60 also functions to provide a position for an air vent opening for the cooling air for cooling the inside of the casing 62.

Figure 4:
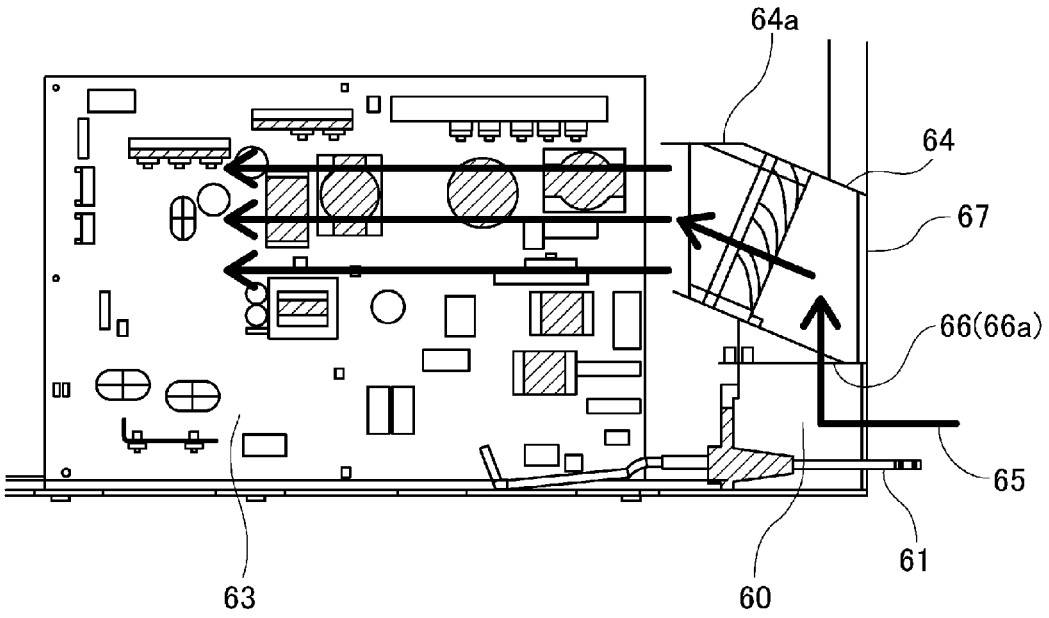
FIG. 4 is a sectional view taken along a line B-B of the image forming apparatus.

As shown in FIG. 4, for example, one of the wall surfaces of the recess 60 is provided at the top surface of the recess 60 with a recess suction louver 66 as a venting hole. The recess suction louver 66 may be constituted by a slit or slits having a total area which is substantially the same as the entire top surface, for example. The slit plate 66*a* is a grating plate of plastic resin material or metal material (louver), but it may be a metal net material. By the provision of the slit plate 66*a* or the metal net material, foreign matter (including a finger of the user or service person) is prevented from entering the inside of the casing 62.

In addition, in order to introduce cooling air for cooling the inside of the apparatus into the casing 62, an air feeding device 64 driven by a motor, such as an axial flow fan, a sirocco fan, a blower or the like can be provided.

Figure 3:
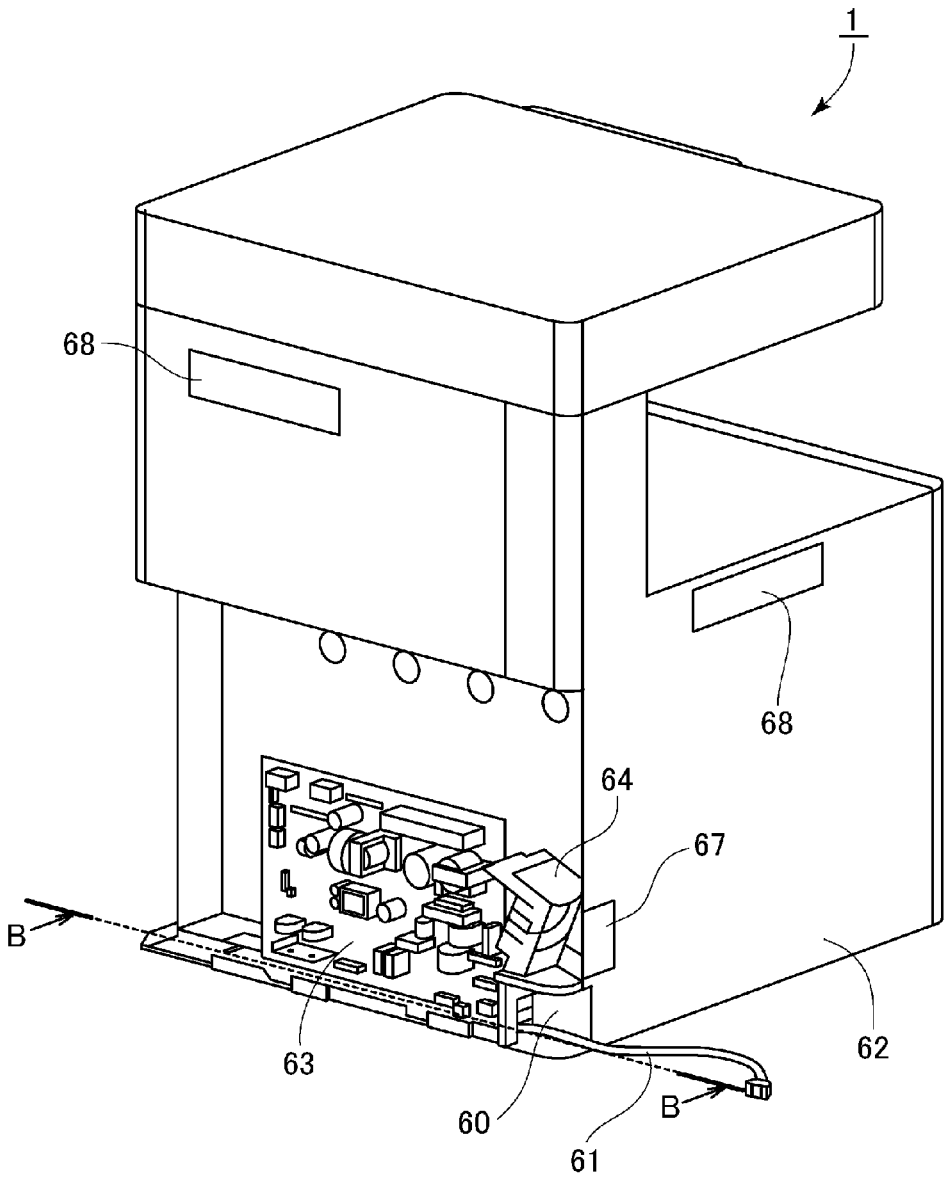
FIG. 3 illustrates a part of an outer casing of the image forming apparatus.

FIG. 3 is a perspective view in which the outer casing of the FIG. 2 is partly removed, wherein the positions of an electric circuit 63 including an electrical component and the air feeding device 64 are depicted. FIG. 4 is a sectional view taken along a line B-B of FIG. 3.

Particularly, FIG. 4 shows the flow 65 of the air, the arrangements of the recess suction louver 66 provided at the recess 60, the air feeding device 64, the electric circuit 63 and the voltage source cable 61. In the example of the structure shown in FIG. 4, the top surface of the recess 60 is provided with the recess suction louver 66 including the slit plate 66*a*, so that the air can easily enter the image forming apparatus 1 through the recess suction louver 66 of the recess 60.

In the example of FIG. 4, the air feeding device 64 is provided in a duct 64*a* provided inclined above the recess suction louver 66 of the recess 60. In the Figure, a lower end and the left part of the duct 64*a* are opened. In addition, in FIG. 4, the right side of the duct 64*a* is open to permit suction through the section louver 67 which will be described hereinafter.

The left part of the duct 64*a* is formed so as to feed the air in the horizontal direction. When the air feeding device 64 is operated, the cooling air 65 introduced through the recess suction louver 66 (or suction louver 67) of the recess 60 is fed substantially in the horizontal direction, from the duct 64*a*.

In addition to the recess suction louver 66, the side surface and rear surface of the casing 62 may be provided with suction and discharging louvers 68, 68 as the venting holes. Among the three discharging louvers 68 shown in FIG. 2, two discharging louvers 68, 68 are disposed on the upper portions of the rear surface and the side surface. The inside image formation mechanism of the image forming apparatus 1 includes various heat generating sources such as the heat-fixing device 20, the motor for driving the feeding roller or the like for the recording material feeding path 1D. The air heated by these heat sources rises in temperature and discharges through the two upper discharging louvers 68, 68.

As shown in FIGS. 3, 4, the suction louver 67 is provided on a lateral side of the casing 62 corresponding to the inlet side of the duct 64*a* of the air feeding device 64. Therefore, as described above, the suction is effected not only through the recess suction louver 66 but also through the suction louver 67, and therefore, a sufficient amount of the cooling air (65) can be supplied toward the left side in FIG. 4.

Preferably, an opening area of the suction louver 67 or the recess suction louver 66 is selected so as to be enough to assure the flow rate of the cooling air (65) which is sufficient to cool the portion to be cooled including the electric circuit 63 and the like, by only one of them. Particularly, the opening area of the recess suction louver 66 of the recess 60 is enough to assure the flow rate of the cooling air (65) which is sufficient to cool the portion to be cooled including the electric circuit 63 and the like, by itself.

By doing so, even when the lateral side of the casing 62 provided with the suction louver 67 is disposed close to the wall of the installation place, the recess suction louver 66 assures the sufficient or close to sufficient amount of the suction. That is, the recess suction louver 66 of the recess 60 alone is enough to avoid lack of cooling air (65).

The discharging louver 68*a* disposed at a lower portion of the back side of the casing 62 has an elongated rectangular shape having a height substantially the same as the circuit board including the electric circuit 63 shown in FIGS. 3 and 4. In the lower portion at the rear side in the casing 62 of the image forming apparatus 1, the electric circuits 63 such as the voltage source substrate, the controller substrate or the high voltage substrate is often placed. As shown in FIG. 4, the cooling air 65 fed in the horizontal direction by the air feeding device 64 passes on the substrate surface of the electric circuit 63 to cool the electrical component on the electric circuit 63, and then is fed toward the discharging louver 68*a* (FIG. 2), where it is discharged. As described hereinbefore, since the discharging louver 68*a* has a longitudinal rectangular shape having substantially the same height as the circuit board including the electric circuit 63, the cooling air 65 can be distributed in a wider range of the circuit board constituting the electric circuit 63. By this, substantially the entire range of the surface of the circuit board constituting the electric circuit 63 can be evenly cooled.

As described in the foregoing, according to this embodiment, the air can be introduced through the recess suction louver 66 of the recess 60 provided for extending the voltage source cable 61 through the casing and/or the suction louver 67, so that the electric circuit 63 in the casing 62 can be cooled.

The recess 60 for extending the voltage source cable 61 out is conveniently provided in the rear side or lower part corner portion of the image forming apparatus 1. This is because in the rear side of the casing of the image forming apparatus, the electrical component, the voltage source substrate for supplying the electric power to the image formation mechanism and the high voltage substrate for generating the high voltage as the electric circuits 63 which are not required to be accessed by the user are placed. By providing the recess suction louver 66 at the recess 60 and providing the suction louver 67 in the neighborhood thereof, the flow path for the cooling air to the electric circuit 63 necessitating the cooling may be short, so that the electric circuit 63 can be efficiently cooled.

Thus, according to this embodiment, by providing the voltage source cable (61) outlet portion in the recess 60, it can be avoided that the certainty and/or durability of the electrical connection is deteriorated due to the sandwiching of the voltage source cable 61 between the main assembly of the image forming apparatus and the wall of the installation place or a sheet post-processing device. In addition, according to this embodiment, the recess suction louver 66 for cooling the inside of the device by the air is provided, utilizing the recess 60. Therefore, even if the suction louver 67 is closed by placing the main assembly of the image forming apparatus in contact with the wall, the sufficient suction amount of the air necessary for the cooling of the inside of the apparatus can be assured by the recess suction louver 66. It is not inevitable to the present invention that the recess 60 is provided at the corner portion, and it may be provided in the central portion of the back side of the apparatus together with the accommodation for the voltage source cable 61, for example, so that a significant decrease of an air feeding efficiency of the air feeding device 64 can be avoided.

Because the recess suction louver 66 is provided at the recess for the outlet of the voltage source cable 61, it is unnecessary to provide an additional recess, and therefore, a design space efficiency is improved, so that the upsizing of the main assembly A can be reduced.

In this embodiment, the air suction is effected through the recess suction louver 66 provided at the recess 60 for the outlet portion of the voltage source cable 61 to concentrically cool the electric circuit 63 for operating the image formation mechanism. However, the venting hole provided at the recess 60 may be an exhaustion opening, that is, the recess suction louver 66 may be a recess discharging louver (66). In such a case, the direction of the airflow provided by the air feeding device 64 is not toward the inside of the apparatus as shown in FIG. 4, but is toward the outside of the apparatus. That is, the venting hole (66) provided at the recess 60 for extending the voltage source cable 61 out of the apparatus is not limited to a suction opening, but it may be an exhaustion opening.

At the inside of the three discharging louvers 68 shown in FIG. 2 and so on in the casing 62, an air feeding device, which may be the same as the above-described air feeding device 64 except for the direction of the airflow, may be provided. As regards the suction louver 67 and the three discharging louvers 68, the slit plate and/or metal net material as described with respect to the recess suction louver 66 may be used to prevent introduction or insertion of the foreign matter and/or a finger of the user or service person.

With this structure described above, the air vent for the cooling air is provided utilizing the recess for the outlet of the electrical cable. Therefore, even when the image forming apparatus is installed close to the wall, it can be avoided that the certainty and/or durability of the electrical connection is deteriorated due to the sandwiching of the voltage source cable or the like between the apparatus and the wall. Additionally, the cooling air is supplied through the air vent provided at the recess, and therefore, even if the image forming apparatus is installed close to the wall, it can be avoided that the air vent clogs with the result of lack of cooling airflow. Furthermore, the air vent can be provided at the recess which is recessed from the surface of the outer casing without using the inside space of the image forming apparatus, and the influence to the outer appearance of the apparatus is minimum.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-009329 filed on Jan. 21, 2015, which is hereby incorporated by reference herein in its entirety.

What is claimed is:

1. An image forming apparatus comprising:

an image forming station configured to form an image on a recording material;

an electric circuit configured to operate said image forming station;

a casing configured to accommodate said image forming station and said electric circuit;

a recess provided on said casing;

a voltage source cable provided on a wall surface of said recess and configured to supply electric power to said electric circuit from an outside of said casing; and an air vent opening formed in a wall surface of said recess for permitting air flow between an inside and an outside to cool an inside of said casing.

2. An apparatus according to claim 1, wherein said voltage source cable is directly extended out through the wall surface of said recess or extended out through a connector provided on the wall surface.

3. An apparatus according to claim 1, further comprising an air feeding device provided inside of said air vent opening and configured to cause the cooling air flow in said casing.

4. An apparatus according to claim 1, wherein said air vent opening is a suction opening for the cooling air.

5. An apparatus according to claim 1, wherein said air vent opening is provided on a top surface of said recess.

6. An apparatus according to claim 1, wherein said recess is provided at a corner portion of a rear side of said casing.

7. An apparatus according to claim 6, wherein the cooling air is supplied through said air vent opening and cools said electric circuit or an image formation mechanism provided in a rear side of said casing.

8. An apparatus according to claim 6, wherein another air vent opening is provided at the rear side of said casing.

9. An apparatus according to claim 6, wherein another air vent opening is provided at a lateral side of said casing.

10. An apparatus according to claim 1, wherein said voltage source cable is connected to said electric circuit.

* * * * *